US010195117B2

(12) United States Patent
Britto

(10) Patent No.: US 10,195,117 B2
(45) Date of Patent: Feb. 5, 2019

(54) VENTED BOTTLE

(71) Applicant: James J. Britto, Westport, MA (US)

(72) Inventor: James J. Britto, Westport, MA (US)

( * ) Notice: Subject to any disclaimer, the term of this patent is extended or adjusted under 35 U.S.C. 154(b) by 265 days.

(21) Appl. No.: 15/170,292

(22) Filed: Jun. 1, 2016

(65) Prior Publication Data

US 2016/0354287 A1 Dec. 8, 2016

Related U.S. Application Data

(60) Provisional application No. 62/170,331, filed on Jun. 3, 2015.

(51) Int. Cl.

| | |
|---|---|
| ***A61J 9/02*** | (2006.01) |
| ***A61J 11/02*** | (2006.01) |
| *A61J 9/04* | (2006.01) |
| *A61J 11/04* | (2006.01) |

(52) U.S. Cl.

CPC ..... *A61J 11/02* (2013.01); *A61J 9/04* (2013.01); *A61J 11/04* (2013.01)

(58) Field of Classification Search

CPC ... A61J 9/04; A61J 11/02; A61J 11/045; A61J 11/04; A61J 9/00

USPC ..... 215/11.5, 11.4, 11.1, 11.6

See application file for complete search history.

(56) References Cited

U.S. PATENT DOCUMENTS

| | | | | |
|---|---|---|---|---|
| 2,156,313 | A | 5/1939 | Schwab | |
| 2,742,168 | A | 4/1956 | Panetti | |
| 3,704,803 | A | 12/1972 | Ponder | |
| 5,449,098 | A | 9/1995 | Offman | |
| 5,570,796 | A | 11/1996 | Brown et al. | |
| 6,250,487 | B1 | 6/2001 | Tebeau | |
| 7,210,591 | B2 | 5/2007 | Goldman et al. | |
| 7,537,128 | B2 * | 5/2009 | Nachumi | A61J 9/006 215/11.1 |
| 7,828,165 | B2 | 11/2010 | Brown et al. | |
| 8,113,365 | B2 * | 2/2012 | Brown | A61J 9/04 215/11.1 |
| 8,146,759 | B2 | 4/2012 | Brown et al. | |
| 8,579,130 | B2 | 11/2013 | Brown et al. | |

(Continued)

FOREIGN PATENT DOCUMENTS

| | | | |
|---|---|---|---|
| EP | 2133061 | B1 | 7/2013 |
| WO | WO2014187405 | A1 | 11/2014 |

*Primary Examiner* — Fenn C Mathew
*Assistant Examiner* — Cynthia Collado
(74) *Attorney, Agent, or Firm* — Fish & Richardson P.C.

(57) ABSTRACT

In one aspect of the invention features nursing bottle. The nursing bottle includes a container for holding a liquid and having a rim defining an open end and a nipple assembly secured to the container at the open end. The nipple assembly includes a flexible nipple extending away from the container and defining an interior nipple volume, a vent bulb disposed within the interior nipple volume and defining an interior bulb volume, a tube extending into the container to a distal end disposed in a closed end of the container, and a vent manifold. The vent manifold defines a first aperture providing fluid communication between the container and the interior nipple volume, a second aperture providing fluid communication between the tube and the interior bulb volume, and a vent conduit providing fluid communication between the interior bulb volume and atmosphere.

20 Claims, 7 Drawing Sheets

(56) References Cited

U.S. PATENT DOCUMENTS

| | | | | |
|---|---|---|---|---|
| 2004/0035815 | A1* | 2/2004 | Webb | A47G 19/2272 215/11.4 |
| 2004/0089626 | A1* | 5/2004 | Pyun | A61J 9/006 215/11.5 |
| 2008/0099422 | A1* | 5/2008 | Rees | A61J 9/006 215/11.5 |
| 2009/0071926 | A1* | 3/2009 | Berkovitch | A61J 9/04 215/11.4 |
| 2009/0139950 | A1* | 6/2009 | Greter | A61J 11/005 215/11.5 |
| 2011/0180632 | A1* | 7/2011 | Shkolnikov | B05B 7/2408 239/375 |
| 2016/0106628 | A1* | 4/2016 | Kemper | A61J 9/00 215/11.5 |

* cited by examiner

VENTED BOTTLE

CROSS-REFERENCE TO RELATED APPLICATION

This application claims the benefit of the filing date of U.S. Provisional Application No. 62/170,331, filed on Jun. 3, 2015. The contents of U.S. application Ser. No. 62/170,331 are incorporated herein by reference in their entirety.

TECHNICAL FIELD

This invention relates to bottle venting, particularly the venting of nursing bottles.

BACKGROUND

There are many types of bottles for feeding nursing infants through a flexible nipple. If excessive vacuum accumulates in the bottle, it can be hard for the infant to draw fluid through the nipple. Some bottles have internal pouches that collapse as they are emptied. Others have various types of venting systems that allow air to enter the bottle during feeding. However, air ingestion can be a source of discomfort for infants. It is also desirable that bottle venting systems not excessively leak.

Improvements are continually sought in the design of venting systems for bottles.

SUMMARY

In one broad aspect of the invention features nursing bottle. The nursing bottle includes a container for holding a liquid and having a rim defining an open end and a nipple assembly secured to the container at the open end. The nipple assembly includes a flexible nipple extending away from the container and defining an interior nipple volume, a vent bulb disposed within the interior nipple volume and defining an interior bulb volume, a tube extending into the container to a distal end disposed in a closed end of the container, and a vent manifold. The vent manifold defines a first aperture providing fluid communication between the container and the interior nipple volume, a second aperture providing fluid communication between the tube and the interior bulb volume, and a vent conduit providing fluid communication between the interior bulb volume and atmosphere. The vent conduit extends to a conduit opening spaced from a lowermost extent of the interior bulb volume with the nipple pointing upward, such that liquid within the vent bulb but below the conduit opening drains into the tube.

In some cases, the vent bulb can be of greater interior volume than the tube. The vent bulb can define a drain volume within the vent bulb and below the conduit opening with the bottle upright, where the drain volume is greater than volume of the tube.

In some implementations, the tube can include a first portion in fluid communication with the first aperture of the vent manifold and a second portion extending from the first portion toward the closed end of the container, where the second portion has a smaller interior diameter than the first portion. The first portion can be separable from the second portion.

The vent bulb and tube can be removably attached to the vent manifold. In some implementations, an o-ring seal can be disposed between the vent bulb and the vent manifold and between the tube and the vent manifold.

In some implementations, the first aperture of the vent manifold can be one of a plurality of discrete apertures defining parallel flow paths between the container and the interior nipple volume. In some implementations, the second aperture of the vent manifold can be one of a plurality of apertures defining parallel flow paths between the tube and the interior bulb volume.

The vent bulb and tube can be sealed to the vent manifold by a detachable friction fit. The vent bulb can be rigid. The vent bulb and tube can be sealed to the vent manifold by ring seal. The vent conduit can open to the atmosphere between the rim of the container and the flexible nipple.

Another aspect of the invention features a nipple assembly for use with a baby bottle. The nipple assembly includes a flexible nipple defining an interior nipple volume, a vent bulb disposed within the interior nipple volume and defining an interior bulb volume, a tube extending away from the nipple, and a vent manifold. The vent manifold defines a first aperture arranged to provide fluid communication between a bottle and the interior nipple volume with the nipple assembly mounted on the bottle, a second aperture providing fluid communication between the tube and the interior bulb volume, and a vent conduit providing fluid communication between the interior bulb volume and atmosphere. The vent conduit extends to a conduit opening spaced from a lowermost extent of the interior bulb volume with the nipple pointing upward, such that liquid within the vent bulb but below the conduit opening drains into the tube.

Another aspect of the invention features a method of feeding a baby. The method includes placing liquid in a container having a rim defining an open end. Securing a nipple assembly (as described above) to the container at the open end. Inverting the container such that liquid inside the tube flows into the interior bulb volume. Positioning the nipple of the inverted container in a mouth of the baby, thereby enabling suckling by the baby to draw liquid from the nipple, and then righting the container, thereby causing liquid from the interior bulb volume to flow into the tube.

The concepts described herein may provide several advantages in bottle assemblies. For example, implementations of the invention may provide continuous venting with low risk of leakage. Continuous venting can result in more natural flow of fluid to a suckling baby, preventing a vacuum in the bottle, and preventing aeration of the liquid. In some cases, the prevention of a vacuum in the bottle may result in reduced gasping and gulping by a suckling baby. These ideas are readily implemented in other types of drinking containers, such as sports water bottles and the like.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
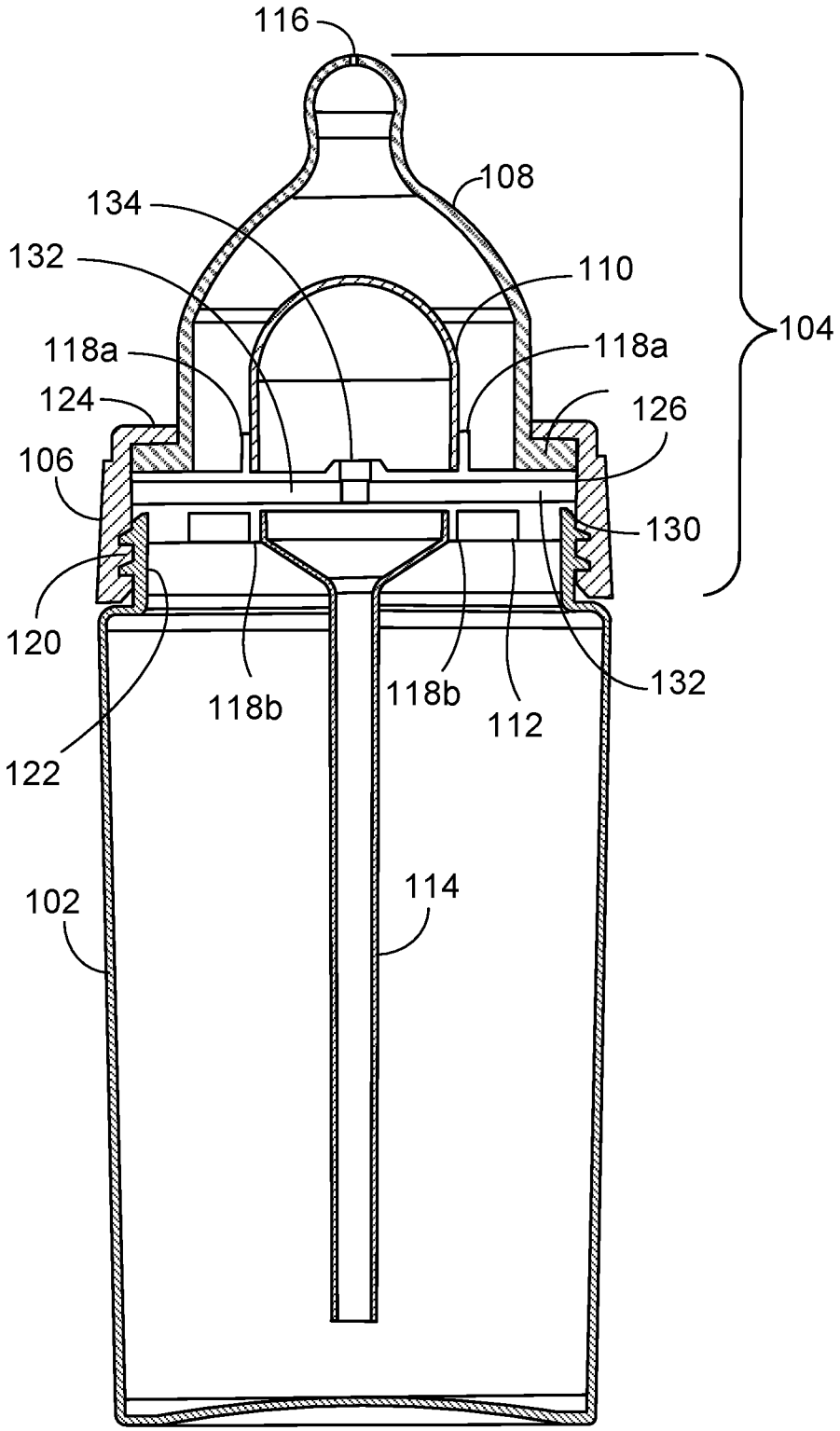
FIG. 1 is a cross-sectional view of an example baby bottle assembly.
Figure 2:
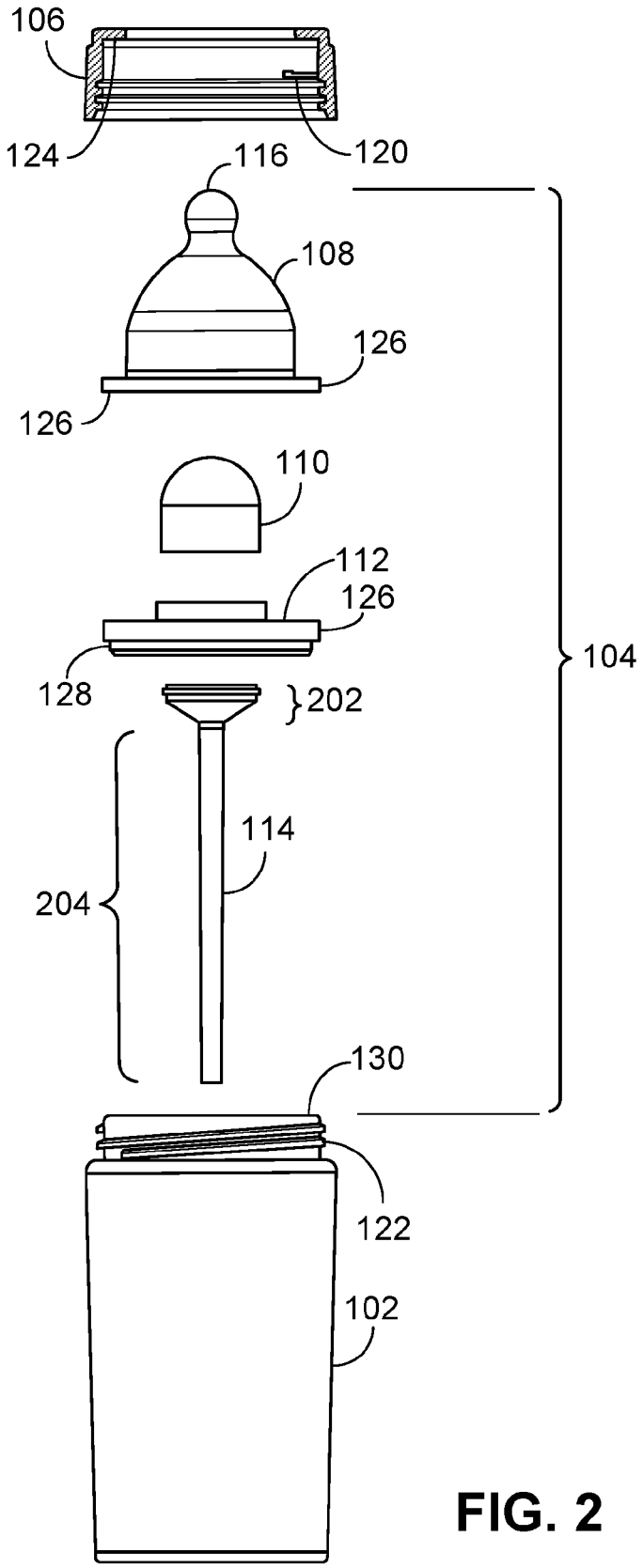
FIG. 2 is a partial exploded side view of an example baby bottle assembly.

As shown in FIGS. 1 and 2, a baby bottle assembly 100 includes a container 102 for holding a fluid, such as milk or water. A nipple assembly 104 mates with an open end of the container 102 and a securing device 106 secures the nipple assembly 104 to the open end of the container 102.

The nipple assembly 104 includes a nipple 108, a vent bulb 110, a vent manifold 112, and a tube 114. The nipple 102 is made from a generally flexible material and includes an aperture 116 at the nursing end to allow passage of fluid from the container 102. The aperture 116 could be, for example, a centrally disposed hole positioned at an intersection of an axial centerline of the nipple 108 to allow passage of fluid from the container 102. The aperture 116 can be a plurality of holes. Alternatively, the aperture 116 could be a slit in nipple 108. The slit could, for example, open to allow passage of fluid when the nipple 108 is compressed, and close to inhibit passage of fluid when the nipple 108 is in its static position. The slit could be configured, for example, with an I-shape or an X-shape.

The vent bulb 110 mates with an upper surface of the vent manifold 112 and the tube 114 mates with a lower surface of the vent manifold. For example, the vent bulb 110 and tube 114 can each mate with a corresponding lip 118*a*, 118*b* of the vent manifold 112. For example, an outer surface of the vent bulb 110 can mates with a lip 118*a* extending from an upper surface of the vent manifold 112 forming a fluid tight seal.

The vent bulb 110 can be secured to the vent manifold 112 by any appropriate means such as, for example, a detachable friction fit between the vent bulb 110 and the lip 118*a* or corresponding threading on the vent bulb 110 and the lip 118*a*. In some examples, an O-ring seal can be disposed between the vent bulb 110 and the vent manifold 112. In some examples, the vent bulb 110 can be permanently bonded to the vent manifold 112. The vent bulb 110 can be, for example, composed of a rigid material (e.g., a rigid polymer material). In some examples, the vent bulb 110 can be composed of a flexible material (e.g., a flexible polymer material). In some examples, the vent bulb 110 can include a flexible portion (e.g., a rubber bulb) and a rigid portion (e.g., a rigid ring) for securing the vent bulb 110 to within the manifold lip 118*a*.

The tube 114 includes an upper portion 202 (e.g., the bowl shaped portion) and a lower portion 204. An outer surface of an upper portion 202 of the tube 114 can mate with a lip 118*b* extending from a lower surface of the vent manifold 112 to form a fluid tight seal. In some examples, the interior diameter of the lower portion 204 is smaller than the interior diameter of the upper portion 202. In some examples, the upper portion 202 of the tube 114 can be separable from the lower portion 204.

The upper portion 202 of the tube 114 can be secured to the vent manifold 112 by any appropriate means such as, for example, a detachable friction fit between the upper portion 202 of the tube 114 and the lip 118*b* or corresponding threading on the upper portion 202 and on the lip 118*b*. In some examples, an O-ring seal is disposed between the upper portion 202 of the tube 114 and the vent manifold 112. In some examples, the upper portion 202 of the tube 114 can be permanently bonded to the vent manifold 112. The tube 114 can be, for example, composed of a rigid material (e.g., a rigid polymer material). In some examples, the tube 114 is composed of a flexible material (e.g., a flexible polymer material).

The securing device 106 has threads 120 disposed on an internal surface that can mate with corresponding threads 122 on an outer surface on the container 102. The nipple 108 can be positioned between the securing device 106 and the container 102. The securing device 106 can be fastened to the container 102. When so assembled, an internal collar 124 of the securing device 106 contacts an annular flange 126 of nipple 108 to compress it and also to compress an annular flange 128 of the vent manifold 112, thereby securing the nipple 108 and the vent manifold 112 to the container 102. Other securing techniques known to those possessing ordinary skill in the art may be possible.

Referring to FIG. 1, when assembled, the annular flange 126 of the nipple 108 and the annular flange 128 of the vent manifold 112 mate with the rim 130 of the container 102. The vent bulb 110 is disposed within an interior volume defined by the nipple 108, and the tube 114 extends into the interior of the container 102 where the distal end of the tube 114 is proximate to the closed end of the container 102. Further, the vent bulb 110 defines an interior bulb volume between the upper surface of the vent manifold 114 and the inner surface of the vent bulb 110. Because the vent bulb 110 is disposed within the interior volume of the nipple 108 the interior bulb volume is also disposed within the interior volume of the nipple 108. In some examples, the interior bulb volume is greater than an interior volume of the lower portion 204 of the tube 114, but less than the an interior volume of the combined upper 202 and lower portions 204 of the tube 114. In some examples, the interior bulb volume is greater than an interior volume of the tube 114 (e.g., the combined interior volume of both the upper portion 202 and the lower portion 204 of the tube 114).

Further, the vent manifold 112 defines a vent conduit 132 that provides fluid communication between the interior bulb volume and the atmosphere. The vent conduit 132 extends from an opening at the outermost portion of the manifold flange 128 to a conduit opening 134 spaced from the interior surface of the vent bulb 110 and the lowermost extent of the interior bulb volume. In some examples, a conduit tube 136 can extend away from the vent manifold 112 and into the interior of the bulb volume, thereby spacing the conduit opening 134 away from the vent manifold 112. The length of the conduit tube 136 can be configured to prevent liquid from splashing into the conduit opening 134 when the bottle assembly 100 is righted. (e.g., liquid that flows into the interior bulb volume when the bottle assembly 100 is inverted for feeding a baby) In such examples, the portion of the interior bulb volume between the conduit opening 134 at the end of the conduit tube 136 and the vent manifold 112 can be considered a drain volume, because it temporarily retains the fluid draining from the interior bulb volume when the bottle assembly 100 is righted. In some examples, the drain volume is greater than an interior volume of the lower portion 204 of the tube 114. In some examples, the drain volume is greater than an interior volume of the tube 114 (e.g., the combined interior volume of both the upper portion 202 and the lower portion 204 of the tube 114).

As described in more detail below in reference to FIGS. 3A-3C, the vent manifold 112 defines at least two apertures. A first aperture provides fluid communication between the container 102 and the interior volume of the nipple 108, and a second aperture provides fluid communication between the tube 114 and the interior volume of the vent bulb 110.

In use, the bottle assembly 100 is partially inverted to allow fluid from the container 102 to flow into the interior volume of the nipple 108. The fluid flows through the first aperture of the vent manifold 112 and around the outer surface of the vent bulb 110. As described in more detail below in reference to FIGS. 5 and 6, when the bottle assembly 100 is partially inverted, fluid contained in the tube 114 flows through the second aperture in the vent manifold 112 into the interior volume of the vent bulb 110. The interior bulb volume is of greater volume than the tube, and thus, serves as a reservoir for fluid draining from the tube 114. Thus, the tube 114 can be emptied of fluid, and due to the fluid flowing into the nipple 108, the fluid at the bottom of the container 102 will uncover the distal end of the tube 114. A vent path is, thereby, established from the distal end of the tube 114 to the atmosphere through the second aperture of the vent manifold 112, the vent bulb 110, and the vent conduit 132. As a baby suckles fluid from the bottle assembly 100, air can be readily drawn into the container 102 through the established vent path, thereby, preventing the formation of a vacuum in the bottle assembly.

Figure 3A:
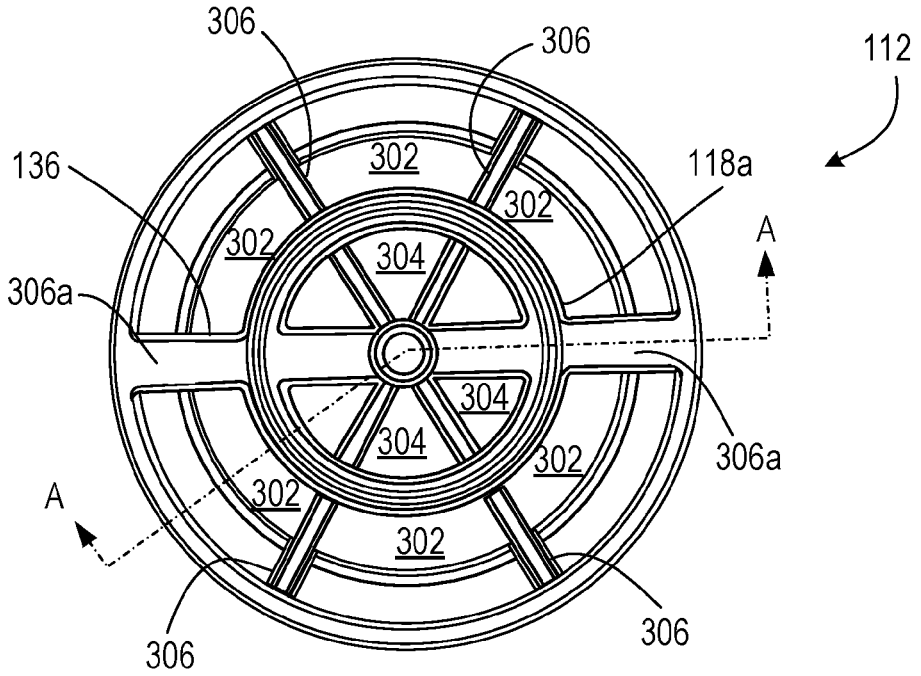
FIG. 3A is a top view of an example vent manifold.
Figure 3B:
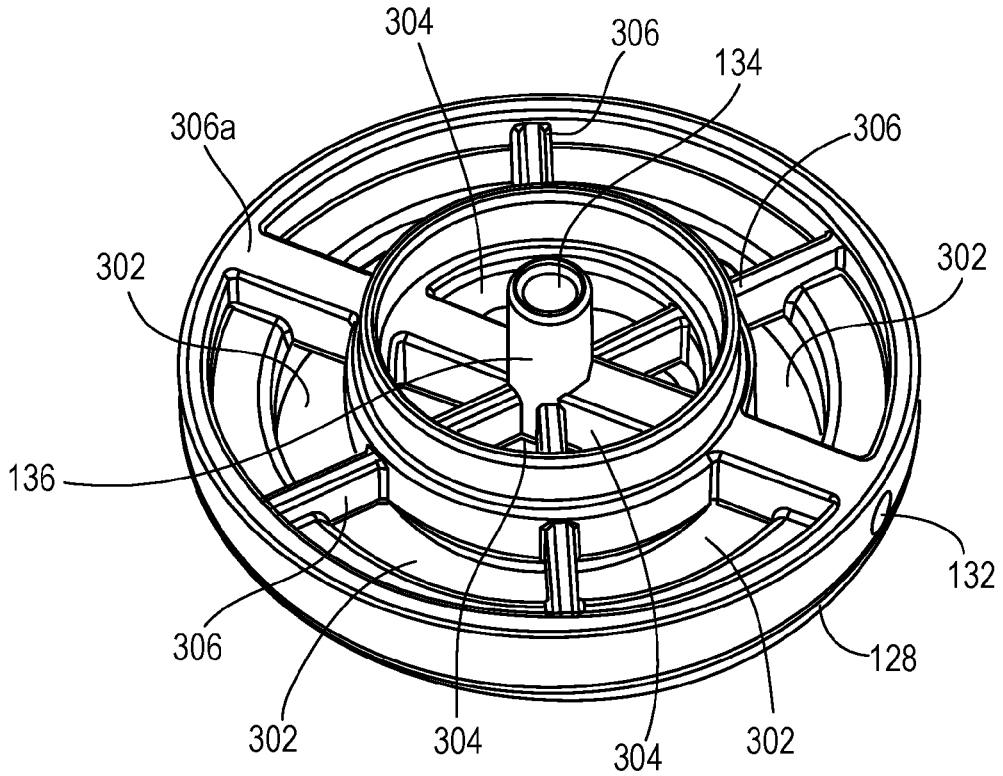
FIG. 3B is a perspective view of an example vent manifold.
Figure 3C:
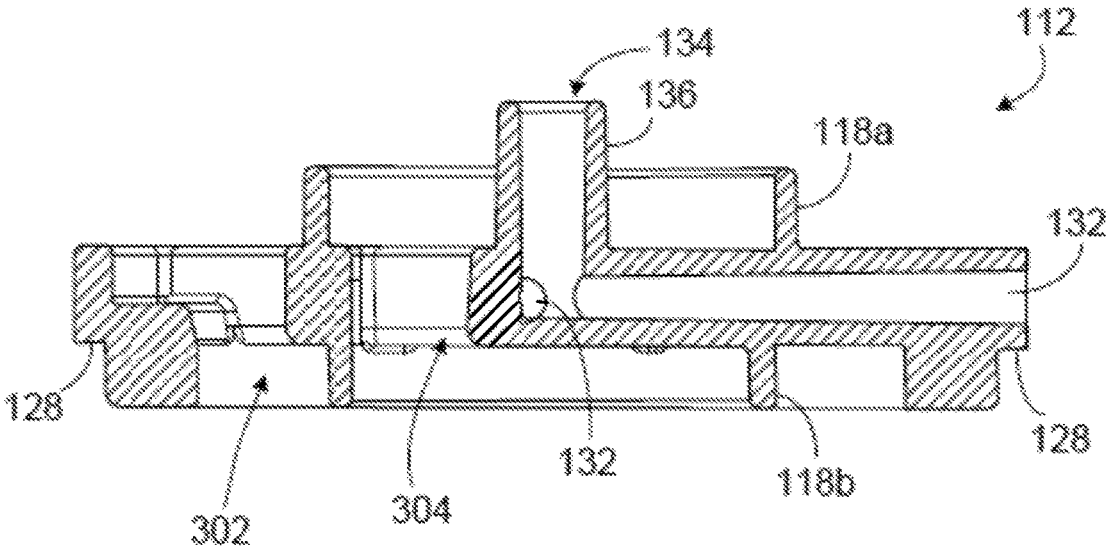
FIG. 3C is a cross-sectional view of the example vent manifold.

Referring to FIGS. 3A and 3B, vent manifold 112 defines one or more outer apertures 302 that provide fluid communication between the container 102 and the interior volume of the nipple 108, and one or more inner apertures 304 that provide fluid communication between the tube 114 and the interior volume of the vent bulb 104. For example, the vent manifold 112 defines an outer aperture 302, or optionally a set of outer apertures, that provide fluid communication between the container 102 and the interior volume of the nipple 108. The outer aperture(s) 302 can be, for example, positioned annularly at intervals around the perimeter of the vent manifold 112, forming parallel flow paths between the container 102 and the interior volume of the nipple 108. The outer aperture(s) 302 are positioned radially outward from the lips 118*a*, 118*b* for securing the vent bulb 110 and the tube 114 to the vent manifold 112, thereby forming a flow path around both the vent bulb 110 and the tube 114.

Similarly, vent manifold 112 defines an inner aperture 304, or optionally a set of inner apertures, that provide fluid communication between the tube 114 and the interior volume of the vent bulb 110. A set of inner apertures 304 can be, for example, positioned annularly at intervals around the perimeter of the vent manifold 112, forming parallel flow paths between the tube 114 and the interior volume of the vent bulb 110. The inner aperture(s) 304 are positioned radially inward from the lips 118*a*, 118*b* for securing the vent bulb 110 and the tube 114 to the vent manifold 112, thereby, forming a flow path between the interior bulb volume and the tube 114.

As shown in FIG. 3A, the apertures are separated by ribs 306 extending radially from the center of the vent manifold 110. The ribs 306 provide structural support for the vent manifold 110. FIG. 3C shows cross-sectional view of the vent manifold 112 taken at section A-A of FIG. 3A. As shown in FIG. 3C, in addition to providing structural support, at least one rib 306*a* provides the vent conduit 132 defined within the rib 306*a*. The vent manifold 110 can include multiple vent conduits 132, defined within other ribs 306.

Figure 4:
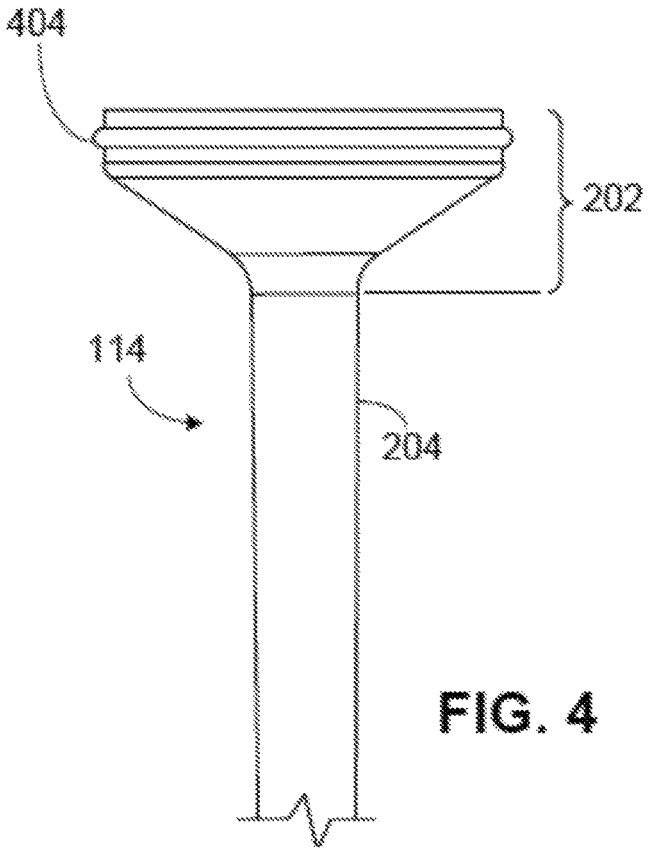
FIG. 4 is a side view of an example vent tube.

Referring also to FIG. 4, the upper portion 202 of the tube 114 (e.g., the bowl shaped portion) is sized to fit into and be secured in a ring formed by the lip 118. In some examples, the outer surface of the upper portion 202 of the tube 114 includes a ridge 404 extending around its circumference. The ridge 404 may provide a friction fit within the lip 118*b* of the vent manifold 112. In some cases the vent bulb includes a similar ridge around the circumference of its outer surface, so as to provide a friction fit within the upper lip 118*a* of the vent manifold 112.

In some examples, the upper portion 202 of the tube 114 is of a conical shape forming a funnel in fluidic communication with the lower portion 204. In some examples, the lengths and inner diameters of the upper and lower portions 202, 204 are configured to minimize the total volume of the tube 114.

Figure 5:
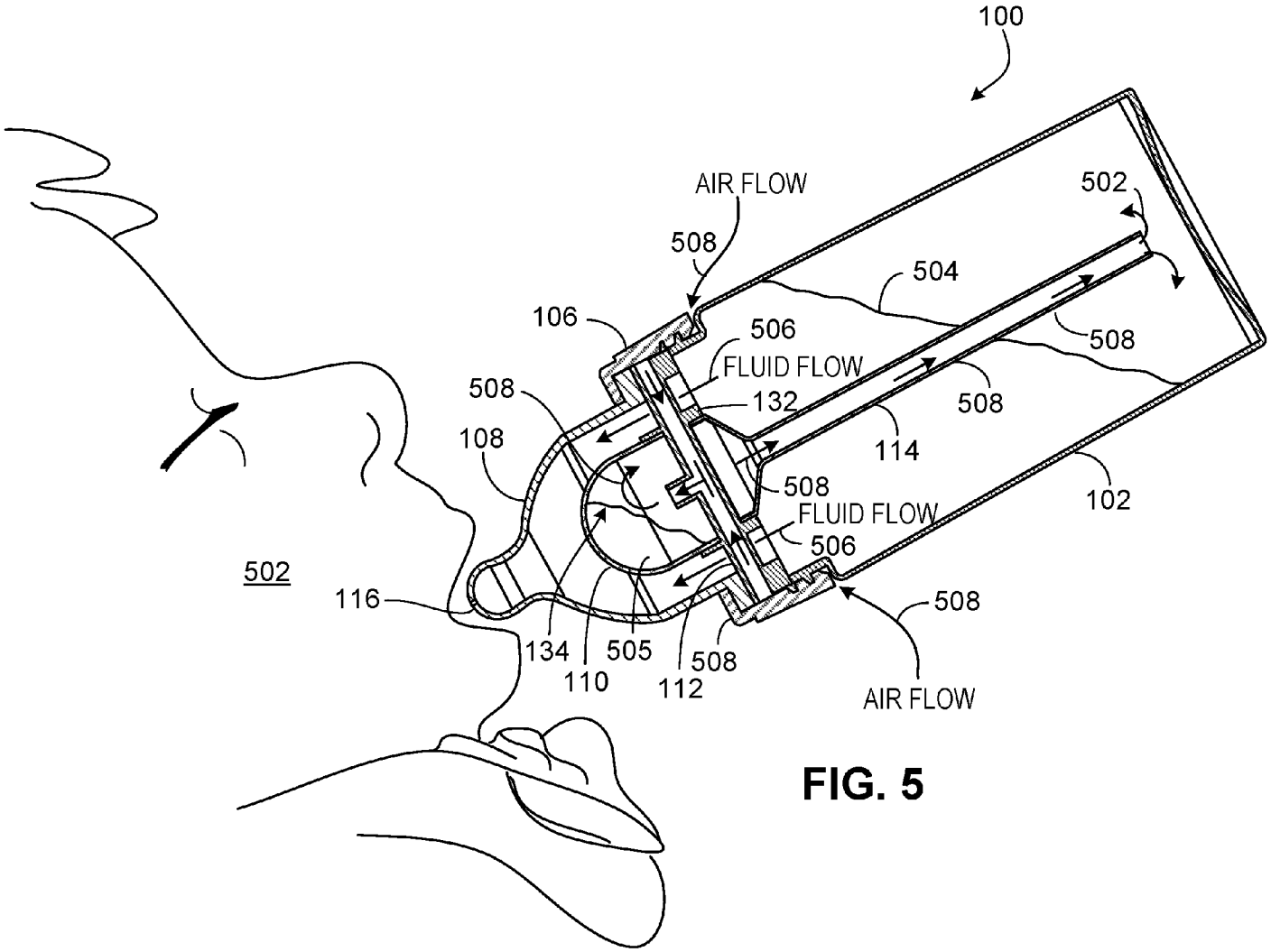
FIG. 5 shows the example bottle assembly in use.

FIG. 5 shows the example bottle assembly 100 in use. The bottle assembly 100 is partially inverted and the nipple 108 in the mouth of a baby 502. As the bottle assembly 100 is inverted fluid 504 in the container 102 flows through the outer aperture(s) 302 of the vent manifold 112 and into the interior volume of the nipple 108, as illustrated by fluid arrows 506. A portion of the fluid 504 that was contained in the tube 114 prior to the bottle assembly 100 being inverted, flows through the inner aperture(s) 304 and into the interior volume of the vent bulb 110 (represented by fluid portion 505).

The interior bulb volume is of greater volume than the tube, and thus, serves as a reservoir for fluid 505 draining from the tube 114. Thus, a portion of fluid 505 in the tube 114 can be emptied into the bulb volume. Further, due to the fluid 504 flowing into the nipple 108, the fluid 504 at the bottom of the container 102 will uncover the distal end of the tube 114. A vent path (represented by arrows 508) is, thereby established from the distal end of the tube 114 to the atmosphere through the second aperture of the vent manifold 112, the vent bulb 110, and the vent conduit 132.

As the baby 502 suckles the fluid 504 through the aperture 116 in the nipple 108, the baby's 502 mouth forms a seal with the nipple 108 preventing air from entering the bottle assembly through the nipple aperture 116. The vent path (arrows 508) established through the tube 114, vent bulb 110, and conduit 132 permits air to flow into the container 102, thereby preventing the formation of a vacuum in the bottle assembly 100, and providing a more natural flow of fluid 504 to the baby 502.

Figure 6A:
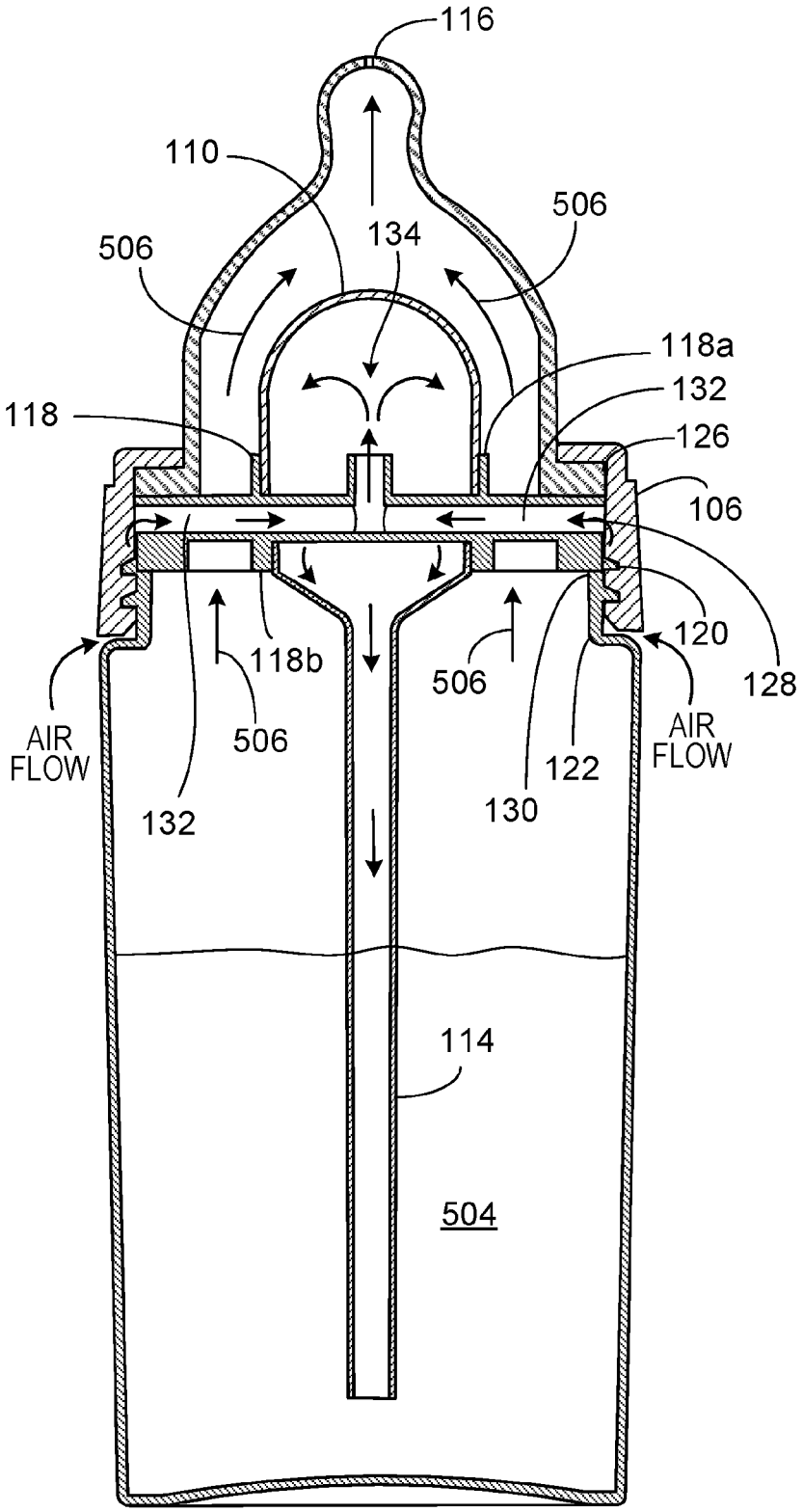
FIGS. 6A and 6B show a detailed view of the vent path through the baby bottle assembly.
Figure 6B:
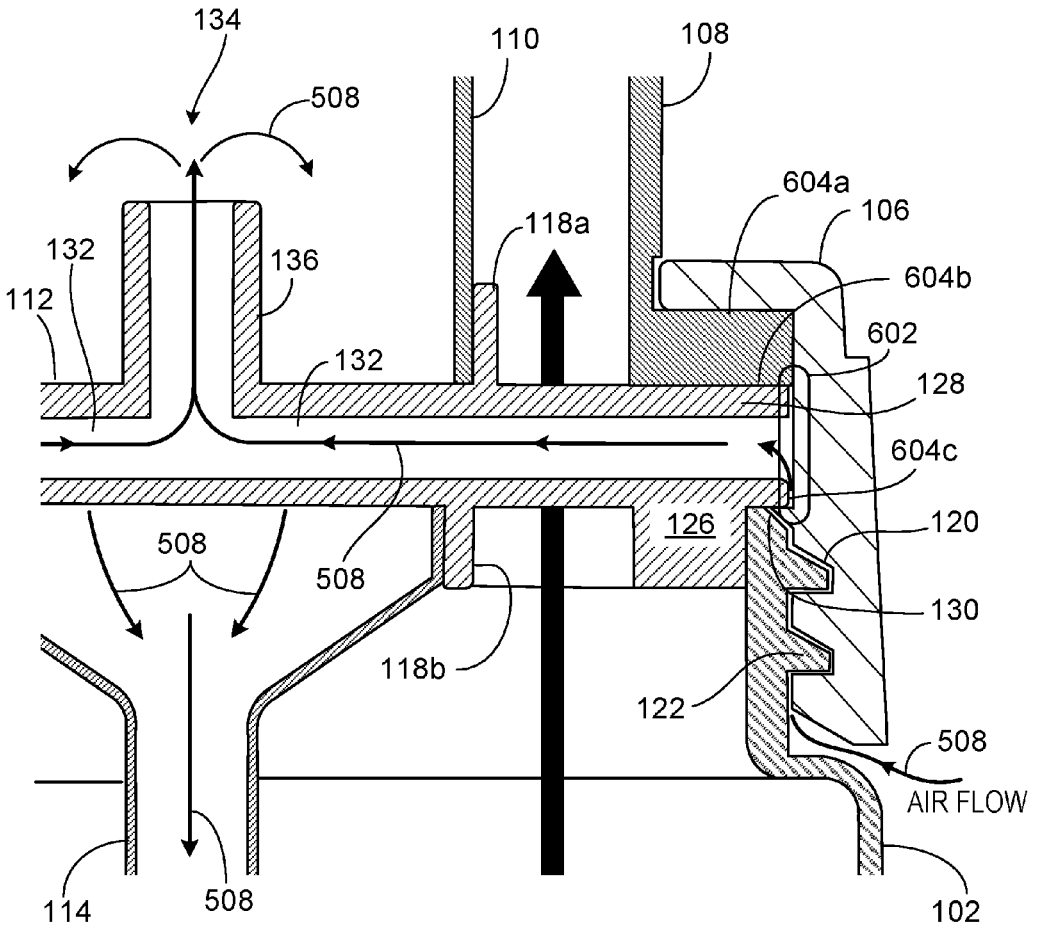

In FIG. 6A the bottle assembly 100 is shown in a righted position, and shows a portion of fluid 505 contained in the tube 114 prior to inversion of the bottle assembly 100. FIG. 6A shows a detailed view of the vent path (arrows 508) through the baby bottle assembly 100. The threading interface 601 between the threads 120 on the securing device 106 and the threads 122 on the container 102 is not air-tight. Air flows through the thread interface 601 and into a gap 602 formed between the annular flange 128 of the vent manifold 112 and the inner surface of the securing device 106. The vent conduit 132 terminates at the edge of the flange 128. Thus, the air flows from the gap 602 through the vent conduit 132, and into the interior volume of the vent bulb 110. From the interior bulb volume the air flows through the inner aperture(s) (not shown) of the vent manifold 112 and into the tube 114. Referring back to FIG. 5, air continues down the tube 114 to the distal end and into the bottom end of the container 102.

The gap 602 can be formed by making the diameter of the vent manifold 112 slightly smaller than the outer diameter of the container 102 at its rim 103. Further, to ensure a fluid tight seal between the nipple assembly 104 and the container 102 water tight seals are formed at locations 604*a*, 604*b*, and 604*c*. That is, a fluid tight seal is formed between a lower surface of the collar 124 on the securing device 016 and an upper surface of the annular flange 126 on the nipple 108 (location 604*a*). A fluid tight seal is formed between a lower surface of the annular flange 126 on the nipple 108 and an upper surface of the annular flange 128 on the vent manifold 112 (location 604*b*). And, a fluid tight seal is formed between a lower surface of the annular flange 128 on the vent manifold 112 and an upper surface of the rim 130 of the container 102 (location 604*c*). Consequently, an airflow vent path is provided while preventing fluid from leaking out of the bottle assembly 100 when inverted.

A baby can be fed with bottle assembly 100 by placing liquid in container 102, securing nipple assembly 104 to the container at its open end, inverting the container such that liquid inside the tube 114 flows into the interior bulb volume, and positioning nipple 108 of the inverted container in a mouth of the baby, thereby enabling suckling by the baby to draw liquid from the nipple 108. After feeding, the container 102 is righted, thereby causing liquid from the interior bulb volume to flow into the tube 114.

While a number of examples have been described for illustration purposes, the foregoing description is not intended to limit the scope of the invention, which is defined by the scope of the appended claims. There are and will be other examples and modifications within the scope of the following claims.

What is claimed is:

1. A nursing bottle, comprising:

a container for holding a liquid and having a rim defining an open end; and a nipple assembly secured to the container at the open end, the nipple assembly comprising:

a flexible nipple extending away from the container and defining an interior nipple volume;

a vent bulb disposed within the interior nipple volume and defining an interior bulb volume;

a tube extending into the container to a distal end disposed in a closed end of the container; and a vent manifold defining:

a first aperture providing fluid communication between the container and the interior nipple volume;

a second aperture providing fluid communication between the tube and the interior bulb volume; and a vent conduit providing fluid communication between the interior bulb volume and atmosphere, the vent conduit extending to a conduit opening spaced from a lowermost extent of the interior bulb volume with the nipple pointing upward, such that liquid within the vent bulb but below the conduit opening drains into the tube, wherein the tube comprises: a first portion in fluid communication with the first aperture of the vent manifold, and a second portion extending from the first portion toward the closed end of the container, the second portion having a smaller interior diameter than the first portion, and wherein the vent bulb defines a drain volume within the vent bulb and below the conduit opening with the bottle upright, and wherein the drain volume is greater than a volume of the second portion of the tube.

2. The nursing bottle of claim 1, wherein the vent bulb is of greater interior volume than the volume second portion of the tube.

3. The nursing bottle of claim 1, wherein the vent bulb and tube are removably attached to the vent manifold.

4. The nursing bottle of claim 3, further comprising an O-ring seal disposed between the vent bulb and the vent manifold and between the tube and the vent manifold.

5. The nursing bottle of claim 1, wherein the first aperture is one of a plurality of discrete apertures defining parallel flow paths between the container and the interior nipple volume.

6. The nursing bottle of claim 1, wherein the second aperture is one of a plurality of apertures defining parallel flow paths between the tube and the interior bulb volume.

7. The nursing bottle of claim 1, wherein the vent bulb and tube are sealed to the vent manifold by a detachable friction fit.

8. The nursing bottle of claim 1, wherein the vent bulb is rigid.

9. The nursing bottle of claim 1, wherein the vent conduit opens to the atmosphere between the rim of the container and the flexible nipple.

10. The nursing bottle of claim 1, wherein the first portion is separable from the second portion.

11. A nipple assembly for use with a baby bottle, the nipple assembly comprising:

a flexible nipple defining an interior nipple volume;

a vent bulb disposed within the interior nipple volume and defining an interior bulb volume;

a tube extending away from the nipple; and a vent manifold defining:

a first aperture arranged to provide fluid communication between a bottle and the interior nipple volume with the nipple assembly mounted on the bottle;

a second aperture providing fluid communication between the tube and the interior bulb volume; and a vent conduit providing fluid communication between the interior bulb volume and atmosphere, the vent conduit extending to a conduit opening spaced from a lowermost extent of the interior bulb volume with the nipple pointing upward, such that liquid within the vent bulb but below the conduit opening drains into the tube, wherein the tube comprises: a first portion in fluid communication with the first aperture of the vent manifold, and a second portion extending from the first portion and away from the nipple, the second portion having a smaller interior diameter than the first portion, and wherein the vent bulb defines a drain volume within the vent bulb and below the conduit opening with the bottle upright, and wherein the drain volume is greater than a volume of the second portion of the tube.

12. The nipple assembly of claim 11, wherein the interior bulb volume is equal to or greater than the volume of the second portion of the tube.

13. The nipple assembly of claim 11, wherein the first portion is separable from the second portion.

14. The nipple assembly of claim 11, wherein the vent bulb and tube are sealed to the vent manifold by a detachable friction fit.

15. The nipple assembly of claim 11, wherein the vent conduit extends away from the vent manifold and into the interior bulb volume of the vent bulb towards the nipple.

16. The nipple assembly of claim 11, wherein the first aperture comprises a plurality of apertures providing fluid communication between the bottle and the interior nipple volume, and wherein the second aperture comprises a plurality of apertures providing fluid communication between the tube and the interior bulb volume.

17. The nipple assembly of claim 11, wherein the vent bulb and tube are removably attached to the vent manifold.

18. The nipple assembly of claim 17, further comprising an O-ring seal disposed between the vent bulb and the vent manifold and between the tube and the vent manifold.

19. A method of feeding a baby, the method comprising placing liquid in a container having a rim defining an open end;

securing a nipple assembly to the container at the open end, the nipple assembly comprising:

a flexible nipple extending away from the container and defining an interior nipple volume;

a vent bulb disposed within the interior nipple volume and defining an interior bulb volume;

a tube extending into the container to a distal end disposed in a closed end of the container; and a vent manifold defining:

a first aperture providing fluid communication between the container and the interior nipple volume;

a second aperture providing fluid communication between the tube and the interior bulb volume; and a vent conduit providing fluid communication between the interior bulb volume and atmosphere, the vent conduit extending to a conduit opening spaced from a lowermost extent of the interior bulb volume with the nipple pointing upward, such that liquid within the vent bulb but below the conduit opening drains into the tube, wherein the tube comprises: a first portion in fluid communication with the first aperture of the vent manifold, and a second portion extending from the first portion toward the closed end of the container, the second portion having a smaller interior diameter than the first portion, and wherein the vent bulb defines a drain volume within the vent bulb and below the conduit opening with the container upright, and wherein the drain volume is greater than a volume of the second portion of the tube; and inverting the container such that liquid inside the tube flows into the interior bulb volume;

positioning the nipple of the inverted container in a mouth of the baby, thereby enabling suckling by the baby to draw liquid from the nipple; and then righting the container, thereby causing liquid from the interior bulb volume to flow into the tube.

20. The method of claim 19, wherein the vent bulb and tube are removably attached to the vent manifold, and wherein the nipple assembly further comprises an O-ring seal disposed between the vent bulb and the vent manifold and between the tube and the vent manifold.

* * * * *